US009989192B2

(12) United States Patent
Lamiable et al.

(10) Patent No.: US 9,989,192 B2
(45) Date of Patent: Jun. 5, 2018

(54) PRESSURE REDUCER WITH FLOW SELECTOR FOR GAS CYLINDER

(71) Applicant: Luxembourg Patent Company S.A., Lintgen (LU)

(72) Inventors: Morgan Lamiable, Metzervisse (FR); Sylvain Heinrich, Yutz (FR); Jean-Claude Schmitz, Heisdorf (LU)

(73) Assignee: Luxembourg Patent Company S.A., Luxembourg (LU)

( * ) Notice: Subject to any disclaimer, the term of this patent is extended or adjusted under 35 U.S.C. 154(b) by 0 days. days.

(21) Appl. No.: 15/124,257

(22) PCT Filed: Mar. 4, 2015

(86) PCT No.: PCT/EP2015/054472
§ 371 (c)(1),
(2) Date: Sep. 7, 2016

(87) PCT Pub. No.: WO2015/132285
PCT Pub. Date: Sep. 11, 2015

(65) Prior Publication Data

US 2017/0016575 A1 Jan. 19, 2017

(30) Foreign Application Priority Data

Mar. 7, 2014 (LU) ..... 92395

(51) Int. Cl.
*F17C 13/04* (2006.01)
*F17C 7/00* (2006.01)

(52) U.S. Cl.
CPC ..... *F17C 7/00* (2013.01); *F17C 13/04* (2013.01); *F17C 2205/035* (2013.01);
(Continued)

(58) Field of Classification Search
CPC ..... F17C 2205/0329; F17C 2205/0382
(Continued)

(56) References Cited

U.S. PATENT DOCUMENTS 3,250,292 A 5/1966 Mollick
6,182,692 B1 2/2001 Fischer et al.
(Continued)

FOREIGN PATENT DOCUMENTS

EP 0869310 A1 10/1998
EP 0959293 A2 11/1999
(Continued)

OTHER PUBLICATIONS

International Search Report from corresponding International Application No. PCT/EP2015/054472, dated May 4, 2015.

*Primary Examiner* — Marina Tietjen
*Assistant Examiner* — Paul J Gray
(74) *Attorney, Agent, or Firm* — Sandberg Phoenix & von Gontard, P.C.

(57) ABSTRACT

A device for regulating the pressure and/or flow of pressurized gas, comprising a body with a gas inlet, a gas outlet and a gas passage connecting the outlet with the inlet, a pressure reducer and a flow selector arranged downstream of the pressure reducer, a hand-wheel rotatably mounted on the body and cooperating with the flow selector for adjusting the flow, and a pressure indicator located at the center of the hand-wheel. The device comprises also a shaft rigidly fixed to the body and rotatably bearing the hand-wheel, the shaft supporting the pressure reducer and comprising a gas channel fluidly connected to the gas passage in the body.

20 Claims, 1 Drawing Sheet

(52) U.S. Cl.
CPC ..... *F17C 2205/0329* (2013.01); *F17C 2205/0338* (2013.01); *F17C 2205/0382* (2013.01); *F17C 2205/0385* (2013.01); *F17C 2250/043* (2013.01)

(58) Field of Classification Search
USPC ..... 137/557, 505; 251/206
See application file for complete search history.

(56) References Cited

U.S. PATENT DOCUMENTS

| | | | | |
|---|---|---|---|---|
| 6,283,146 | B1 | 9/2001 | Okitsu | |
| 7,650,904 | B2 * | 1/2010 | Huang | G05D 16/0669 137/505.18 |
| 2009/0014073 | A1 | 1/2009 | Huang | |

FOREIGN PATENT DOCUMENTS

| | | | |
|---|---|---|---|
| EP | 1522774 | A1 | 4/2005 |
| EP | 2791409 | A1 | 10/2014 |

* cited by examiner

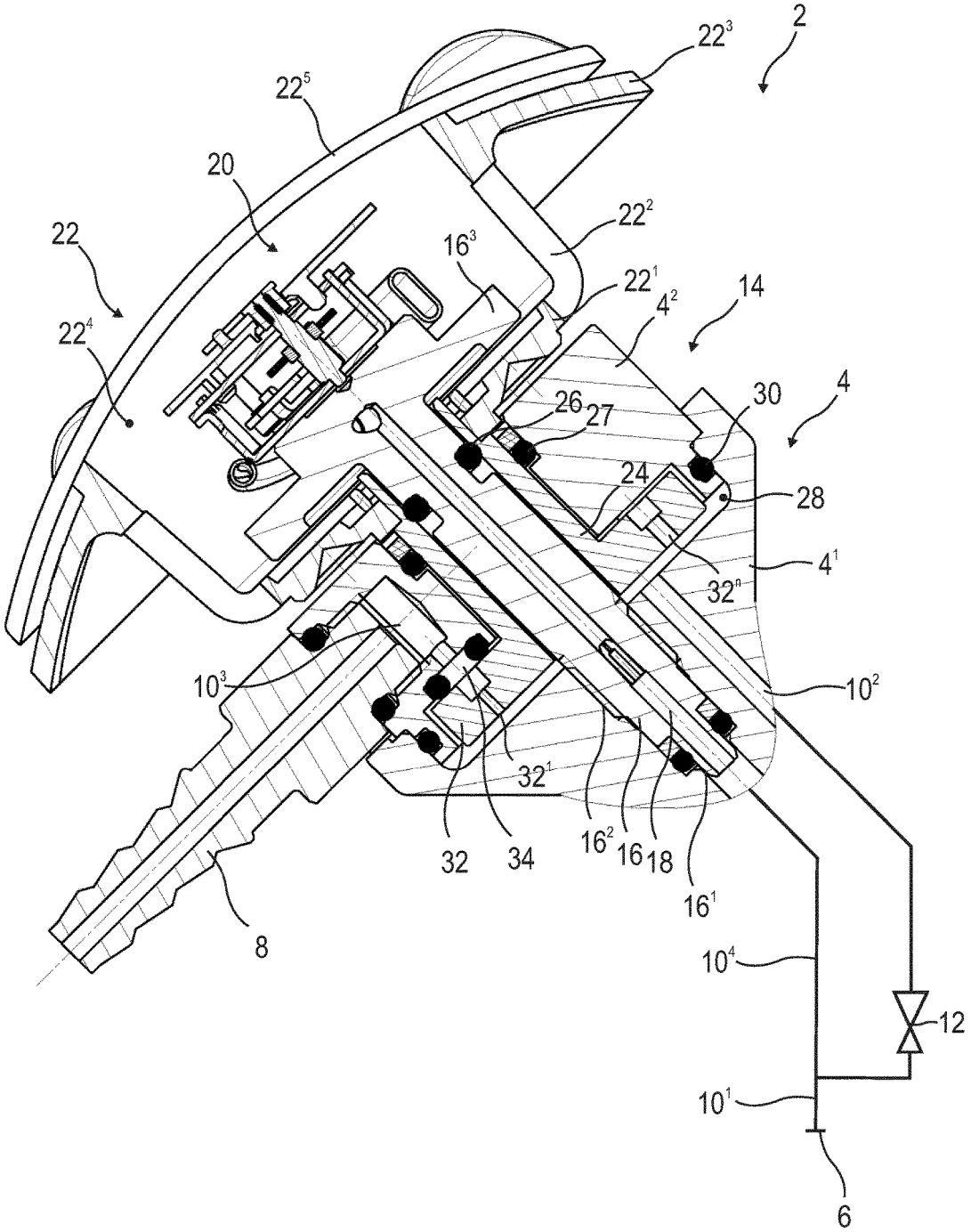
2
22³
22⁵
20
22
22⁴
16³
22²
22¹
4²
14
4
30
26
27
24
28
4¹
32ⁿ
10³
10²
32¹
32
34
16²
16
18
16¹
8
10⁴
12
10¹
6

PRESSURE REDUCER WITH FLOW SELECTOR FOR GAS CYLINDER

CROSS-REFERENCE TO RELATED APPLICATIONS

The present invention is the US national stage under 35 U.S.C. § 371 of International Application No. PCT/EP2015/054472, which was filed on Mar. 4, 2015, and which claims the priority of application LU 92395 filed on Mar. 7, 2014, the content of which (text, drawings and claims) are incorporated here by reference in its entirety.

FIELD

The invention is directed to the field of taps for pressurized gas storage tanks like gas cylinders. Such taps can comprise several functions like a shut-off function, a pressure reducing function and/or a flow selector function.

BACKGROUND

Prior art patent document published EP 2 791 409 A1 discloses a gas cylinder tap with a pressure reducer and a flow selector. The flow selector is operated by means of a hand-wheel that rotates a disk with calibrated holes arranged along a circle in order to bring a specific hole of a calibrated section in front of a gas passage fluidly connected to the gas outlet of the tap. A pressure indicator is housed in the hand-wheel and is mounted on the tap so as not to rotate with the wheel. Indeed, the pressure indicator is supported by a thin shaft that extends through a larger shaft of the hand-wheel and also through the piston of the pressure reducer. The piston comprises a closure element that cooperates with a seat in the tap body. The thin shaft holding the pressure indicator extends through the piston until the closure element so as to be constantly in fluidic connection with the high pressure directly upstream of the seat. The pressure indicator provides therefore information of the pressure in the gas cylinder. This arrangement is however rather bulky in the longitudinal direction of the tap. Also, the pressure indicator is mechanically linked to the piston of the pressure reducer. This means that the pressure indicator is likely to disturb the functioning of the pressure reducer. Indeed, the frictional forces between the shaft and the guiding surfaces in the shaft of the hand-wheel will interfere with the forces acting on the piston for the regulation of the pressure. In addition, the presence of dust or particles between the pressure indicator housing and the internal surface of the hand-wheel might even increase that negative interference.

Prior art patent document published U.S. Pat. No. 6,283,146 B1 discloses also a gas cylinder tap with a pressure reducer and a pressure indicator housed in a hand-wheel. Similarly to the above discussed teaching, the pressure indicator does not turn together with the hand-wheel. This tap does not however comprise any flow selector. The hand-wheel adjusts the pre-setting of the pressure reducer. The pressure indicator is held by a sophisticated arrangement comprising a pressure gauge guide that is longitudinally held in place by means of bolts screwed in a rotatable sleeve of the hand-wheel and engaging in a groove of the guide. This latter is engaged with a non-rotating spring retainer of the pressure reducer, and this in a sliding but non-rotating manner. The pressure indicator is in fluidic connection with the reduced pressure, contrary to the previous document where the pressure indicator is connected to the high pressure in the inlet.

SUMMARY

The invention has for technical problem to provide a more compact and/or more simple tap construction with an adjustment hand-wheel housing a pressure indicator.

The invention is directed to a device for regulating the pressure and/or flow of pressurized gas, comprising: a body with a gas inlet, a gas outlet and a gas passage connecting the outlet with the inlet; a pressure reducer and, preferably, a flow selector arranged downstream of the pressure reducer; a hand-wheel rotatably mounted on the body and cooperating with the pressure reducer and/or the flow selector for adjusting the pressure and/or flow; a pressure indicator located at the center of the hand wheel; wherein the device further comprises: a shaft rigidly extending from the body and rotatably bearing the hand wheel, the shaft supporting the pressure indicator.

According to various embodiments of the invention, the shaft is rigidly fixed to the body, for example by screwing.

According to various embodiments of the invention, the shaft comprises a gas channel fluidly connected to the gas passage in the body.

According to various embodiments of the invention, one end of the shaft comprises a support for the pressure indicator, the other end of the shaft being fixed to the body in a rigid and gas-tight fashion, the other end, in various instances, comprising an external thread mating with an internal thread in the body.

According to various embodiments of the invention, the support extends perpendicularly to the shaft, the support being, in various instances, integrally formed with the shaft and/or comprising means configured to rotatably engage with a tightening tool. The means can comprise an outer contour of the support, with several faces for engaging a polygonal nut. It can also comprise at least two parallel holes on the support for engagement with parallel pins on a specific tool.

According to various embodiments of the invention, the shaft extends through the hand-wheel and the pressure indicator is located at the center and inside the hand-wheel.

According to various embodiments of the invention, it comprises a sleeve rotatably mounted on the shaft, the hand-wheel being attached to the sleeve.

According to various embodiments of the invention, the sleeve comprises, or is attached to, a shoulder portion distant from the hand-wheel; the sleeve being supported by the shaft and surrounded by a bearing portion of the body between the hand-wheel and the shoulder portion.

According to various embodiments of the invention, the bearing portion of the body is a separate portion that is mounted on the rest of the body, the portion being, in various instances, generally flat and/or circular.

According to various embodiments of the invention, the sleeve, the hand-wheel and the bearing portion are configured so that they can be assembled together in a pre-assembly, the shaft inserted through the sleeve can then be fixed to the body and the pre-assembly be fixed to the body.

According to various embodiments of the invention, the shoulder portion comprises a disk with passages of different sections forming the flow selector.

According to various embodiments of the invention, the bearing portion of the body comprises the gas outlet, the outlet, in various instances, extending transversally, preferably at least essentially perpendicularly, to the longitudinal direction of the shaft.

According to various embodiments of the invention, the disk is in rotatable contact with a contact surface of the bearing portion of the body, the surface comprising a hole with a passage in the portion interconnecting the gas outlet with the hole.

According to various embodiments of the invention, the hand-wheel is generally cup-shaped, the pressure indicator being housed in the cavity of the cup.

According to various embodiments of the invention, the body extends essentially along a longitudinal axis of a threaded portion forming the gas inlet and to engage in a gas cylinder neck, the device comprising a pressure reducer that is disposed laterally with regard to the longitudinal axis.

According to various embodiments of the invention, the pressure reduced comprises a movable element that regulates a restricted flow passage, the element being movable in translation along an axis that is transversal, in various instances, essentially perpendicular, to the longitudinal axis of the body.

According to various embodiments of the invention, the device comprises a flow selector fluidly downstream of the pressure reducer, between the gas outlet and the pressure reducer.

According to various embodiments of the invention, the gas channel of the shaft is fluidly connected to the gas passage upstream of the pressure reducer.

The invention is particularly interesting in that it provides a simple and cost effective construction for mounting a hand-wheel with a pressure indicator at its center on the body of regulating device for pressurized gas.

DRAWINGS

The unique FIGURE is a sectional view of a device for regulating the pressure and the flow of pressurized gas, in accordance with various embodiments of the invention.

DETAILED DESCRIPTION

The unique FIGURE a sectional view of a device for gas cylinder with a pressure reducer and a flow selector. The view shows however only the portion of the device that comprises the flow selector, a hand-wheel for adjusting the selector and a pressure indicator housed in the hand-wheel.

The device 2 comprises a body 4 with a gas inlet 6, a gas outlet 8 and a gas passage $\mathbf{10}^1$, $\mathbf{10}^2$ and $\mathbf{10}^3$ connecting with the outlet with the inlet. The device comprises a pressure reducer 12 which is schematically represented in the FIGURE. A pressure reducer is well-known as such by the skilled person and does need to be further detailed. The exit of the pressure reducer 12 is fluidly connected through the gas passage portion $\mathbf{10}^3$ with a flow selector 14. A gas passage portion $\mathbf{10}^4$ connects the inlet 6 directly with a pressure indicator 20 mounted on a shaft 16. The shaft comprises a gas channel 18 extending through the shaft along its longitudinal axis for connecting the pressure indicator with the gas passage at a portion that is upstream of the pressure reducer 12. This means that the pressure indicator informs of the pressure at the inlet, i.e. in the gas cylinder.

The valve body 4 comprises a main portion $\mathbf{4}^1$ and a bearing portion $\mathbf{4}^2$. The shaft 16 is rigidly mounted on the main portion $\mathbf{4}^1$, e.g. by means of a threaded engagement and a gas tight engagement. To provide a stable and rigid mounting, the shaft can comprise a free end portion $\mathbf{16}^1$ with a reduced diameter that engages into a corresponding bore in the main body $\mathbf{4}^1$ and a male thread $\mathbf{16}^2$ portion that is distant from the free end $\mathbf{16}^1$.

A sleeve 24 extends along a portion of the external surface of the shaft 16 so as to be supported by the shaft. The sleeve 24 comprises a shoulder portion shaped as a disk 32 that is located in a flow selection chamber 28 downstream of the pressure reducer 12. This chamber 28 is formed in a cavity of the main body $\mathbf{4}^1$ that is closed by the bearing portion $\mathbf{4}^2$ of the body in a gas tight fashion by means of the joint 30. The disk 32 comprises a series of calibrated holes or apertures $\mathbf{32}^1$ to $\mathbf{32}^n$ where n is an integer greater than 1. These holes or apertures preferably have different flow sections and are configured to be positioned in a selective manner in front of a hole 34 in the bearing portion $\mathbf{4}^2$ of the body, thereby limiting the flow of gas to the outlet 8. Alternatively or in a complementary manner, the number and position of the holes or apertures can be organized such that several of them are in front of the hole 34, the flow section and gas flow being varied with the number of holes or apertures in front of the hole 34.

The hole 34 in the bearing portion $\mathbf{4}^2$ of the body 4 is in direct fluid communication with the gas passage $\mathbf{10}^3$ that fluidly connects the outlet 8 with the hole 34. Sealing means like an O-ring can be placed in a housing formed in the hole 34 so as to provide a gas tight connection with the disk 32. Similarly, sealing means like an O-ring 26 is placed between the internal surface of the sleeve 24 and the external surface of the shaft 24. For instance, an O-ring 26 is placed in a circular groove on the external surface of the shaft, the O-ring contacting the internal surface of the sleeve 24.

The bearing portion $\mathbf{4}^2$ of the body 4 comprises a bore surrounding the sleeve 24. An O-ring 27 is placed in a circular groove in the surface of the bore and contacts the external surface of the sleeve. This provides a gas-tight assembly of the chamber 28.

A hand-wheel 22 is attached to the sleeve 24, more particularly at the portion the sleeve 24 that is distant from the shoulder shaped as a disk 32 and that extends from the bearing portion $\mathbf{4}^2$ of the body 4. To that end, the sleeve 24 can comprise a shoulder portion receiving the bottom portion $\mathbf{22}^1$ of the hand-wheel, this latter being secured against that shoulder portion by means of a nut or ring to be crimped. Means preventing a relative rotation between the hand-wheel and the sleeve are of course foreseen (but not visible in the sectional view).

The hand-wheel 22 is, in various instances, cup-shaped with a bottom wall $\mathbf{22}^1$, a generally flared circular wall $\mathbf{22}^2$ and an external rim $\mathbf{22}^3$. The hand-wheel 22 forms thereby a cavity $\mathbf{22}^4$ that houses the pressure indicator 20. This latter is supported by a front surface or wall $\mathbf{16}^3$ of the shaft 16. The pressure indicator can be a mechanical one with a Bourdon tube as illustrated or any other indicator, like for example a digital one. The pressure indicator 20 is, in various instances, completely housed in the cavity $\mathbf{22}^4$ of the hand-wheel 22. This latter can comprise a transparent cover $\mathbf{22}^5$ extending over the cavity $\mathbf{22}^4$ and protecting the pressure indicator.

Upon manipulation in rotation the hand-wheel transmits its rotational movement to the sleeve 24 and to the disk 32 for selecting the desired flow rate of gas whereas the pressure indicator remains stationary and indicates the inlet pressure, i.e. the pressure in the storage tank.

The above detailed construction is particularly interesting with regard to its assembly. The sleeve 24 can indeed be inserted into the bearing portion $\mathbf{4}^2$ of the body 4 and the hand-wheel 22 can then be mounted on the sleeve 24, thereby providing a pre-assembly. The shaft 16 can be inserted into the sleeve of that pre-assembly. The pre-assembly with protruding free end of the shaft can be brought close to the main body $\mathbf{4}^1$, in the direction of the corresponding bore of the main body. The free end of the shaft 16 serves therefore as guiding means and can then be fastened to the body, for instance by screwing. Afterwards, the bearing portion $\mathbf{4}^2$ of the body 4 can be secured to the main body $\mathbf{4}^1$, e.g. by screwing means (not visible in the presented sectional view).

In the above construction, in various instances, the body comprises a threaded port at the inlet 6 for engagement in the neck of a gas cylinder. The body 4 can therefore extend essentially longitudinally along the axis of that threaded port. This axis can correspond or be parallel essentially to the schematic representation of the gas passages $\mathbf{10}^1$ and $\mathbf{10}^4$. As is visible in the FIGURE, the flow selector 14 is then arranged laterally with regard that longitudinal axis. The axis of the shaft 16 is indeed inclined at an angle comprised between 30° and 60° with the longitudinal axis. The pressure reducer 12 that is only schematically represented can be arranged also laterally, in various instances, at a place around the longitudinal axis that is not yet occupied by the flow selector 14. The pressure reducer 12 can comprise a movable element, like a piston, that controls the position of a shut-off device and delimits a low pressure chamber downstream of the device. This element can be arranged so as to be movable in translation along a direction that is transversal or even generally perpendicular to the longitudinal axis of the regulating device. This provides the advantage that the shaft can easily be fluidly connected with the inlet, e.g. with an essentially central passage $\mathbf{10}^4$ the can be concentric with the longitudinal axis of the regulating device.

The above construction of the hand-wheel has been specifically described in connection with a flow selector. It can however be also applied for the pre-setting and adjustment of a pressure reducer. Indeed, the shoulder portion attached or formed with the sleeve could indeed modify the pre-tension of the spring of a pressure reducer, for example via a threaded engagement.

The invention claimed is:

1. A device for regulating the at least one of pressure and flow of pressurized gas, said device comprising:

a body with a gas inlet, a gas outlet and a gas passage connecting the outlet with the inlet;

a pressure reducer;

a flow selector arranged downstream of the pressure reducer;

a hand-wheel rotatably mounted on the body and cooperating with the flow selector for adjusting the flow;

a pressure indicator located at the center of the hand-wheel; and a shaft with one end rigidly fixed to the body and rotatably bearing the hand-wheel, the shaft supporting the pressure indicator.

2. The device according to claim 1, wherein the shaft is rigidly fixed to the body by screwing.

3. The device according to claim 1, wherein the shaft comprises a gas channel fluidly connected to the gas passage in the body.

4. The device according to claim 1, wherein the one end of the shaft is fixed to the body in a gas-tight fashion, the shaft comprising another end with a support for the pressure indicator.

5. The device according to claim 4, wherein the one end of the shaft comprises an external thread mating with an internal thread in the body.

6. The device according to claim 4, wherein the support extends perpendicularly to the shaft.

7. The device according to claim 4, wherein the support is at least one of:

integrally formed with the shaft; and comprises a surface configured to rotatably engage with a tightening tool.

8. The device according to claim 1, wherein the shaft extends through the hand-wheel, and the pressure indicator is located at the center of and inside the hand-wheel.

9. The device according to claim 1, wherein the device further comprises a sleeve rotatably mounted on the shaft, the hand-wheel being attached to the sleeve.

10. The device according to claim 9, wherein the sleeve one of comprises and is attached to, a shoulder portion distant from the hand-wheel; the sleeve being supported by the shaft and surrounded by a bearing portion of the body between the hand-wheel and the shoulder portion.

11. The device according to claim 10, wherein the body comprises a main portion and the bearing portion, the bearing portion being a separate portion that is mounted on the main portion, and is at least one of flat and circular.

12. The device according to claim 11, wherein the sleeve, the hand-wheel and the bearing portion are configured so that they can be assembled together in a pre-assembly, the shaft inserted through the sleeve can then be fixed to the body and the pre-assembly be fixed to the body.

13. The device according to claim 10, wherein the shoulder portion is shaped as a disk with passages of different cross-sectional areas and forming the flow selector.

14. The device according to claim 10, wherein the bearing portion of the body comprises the gas outlet.

15. The device according to claim 14, wherein the outlet extends perpendicularly to the longitudinal direction of the shaft.

16. The device according to claim 13, wherein the disk is in rotatable contact with a contact surface of the bearing portion of the body, the surface comprising a hole with a passage in the portion interconnecting the gas outlet with the hole.

17. The device according to claim 1, wherein the hand-wheel is cup-shaped with a cavity, the pressure indicator being housed in the cavity.

18. The device according to claim 1, wherein the body extends along a longitudinal axis of a threaded portion forming the gas inlet and is configured to engage in a gas cylinder neck, the pressure reducer being disposed laterally with regard to the longitudinal axis.

19. The device according to claim 18, wherein the pressure reducer comprises a movable element that regulates a restricted flow passage, the element being movable in translation along an axis that is perpendicular to the longitudinal axis of the body.

20. The device according to claim 3, wherein the gas channel of the shaft is fluidly connected to the gas passage at a location that is upstream of the pressure reducer.

* * * * *